US009659762B2

(12) United States Patent
Hutin et al.

(10) Patent No.: US 9,659,762 B2
(45) Date of Patent: May 23, 2017

(54) AMALGAM BALLS HAVING AN ALLOY COATING

(71) Applicant: UMICORE AG & CO. KG, Hanau-Wolfgang (DE)

(72) Inventors: Olivier Hutin, Langenselbold (DE); Hans Martin Ringelstein, Frankfurt (Main) (DE)

(73) Assignee: UMICORE AG & CO. KG, Hanau-Wolfgang (DE)

( * ) Notice: Subject to any disclaimer, the term of this patent is extended or adjusted under 35 U.S.C. 154(b) by 0 days.

(21) Appl. No.: 15/000,752

(22) Filed: Jan. 19, 2016

(65) Prior Publication Data

US 2016/0133453 A1 May 12, 2016

Related U.S. Application Data

(63) Continuation of application No. 14/003,697, filed as application No. PCT/EP2012/053730 on Mar. 5, 2012, now Pat. No. 9,263,245.

(30) Foreign Application Priority Data

Mar. 9, 2011 (EP) ..... 11157478

(51) Int. Cl.

| | |
|---|---|
| ***C22C 7/00*** | (2006.01) |
| ***H01J 61/26*** | (2006.01) |
| ***C22C 5/06*** | (2006.01) |
| ***C22C 13/00*** | (2006.01) |
| ***H01J 61/20*** | (2006.01) |
| ***H01J 9/395*** | (2006.01) |
| ***H01J 9/40*** | (2006.01) |
| ***H01J 61/42*** | (2006.01) |
| ***H01J 61/72*** | (2006.01) |

(52) U.S. Cl.

CPC ..... *H01J 61/26* (2013.01); *C22C 5/06* (2013.01); *C22C 7/00* (2013.01); *C22C 13/00* (2013.01); *H01J 9/395* (2013.01); *H01J 9/40* (2013.01); *H01J 61/20* (2013.01); *H01J 61/42* (2013.01); *H01J 61/72* (2013.01); *Y10T 428/1209* (2015.01); *Y10T 428/12056* (2015.01)

(58) Field of Classification Search

CPC ..... C22C 7/00
USPC ..... 313/490
See application file for complete search history.

(56) References Cited

U.S. PATENT DOCUMENTS

| | | | | |
|---|---|---|---|---|
| 4,015,162 | A | 3/1977 | Evans et al. | |
| 4,071,288 | A | 1/1978 | Evans et al. | |
| 4,145,634 | A | 3/1979 | Evans et al. | |
| 4,216,178 | A | 8/1980 | Anderson | |
| 4,859,412 | A | 8/1989 | Groll et al. | |
| 5,520,560 | A | 5/1996 | Schiabel et al. | |
| 5,828,169 | A | 10/1998 | Myojo et al. | |
| 5,882,237 | A | 3/1999 | Sarver et al. | |
| 6,312,499 | B1 | 11/2001 | Rehmat et al. | |
| 6,339,287 | B1 | 1/2002 | Sarver et al. | |
| 6,791,254 | B2 | 9/2004 | Stafford et al. | |
| 7,297,178 | B2 | 11/2007 | Kempf et al. | |
| 7,538,479 | B2 | 5/2009 | Yagi et al. | |
| 8,497,622 | B2 * | 7/2013 | Ptaschek | C22C 7/00 313/490 |
| 9,263,245 | B2 * | 2/2016 | Hutin | C22C 5/06 |
| 9,324,555 | B2 * | 4/2016 | Ptaschek | C22C 7/00 |
| 2003/0151351 | A1 | 8/2003 | Stafford et al. | |
| 2005/0265018 | A1 | 12/2005 | Yasuda | |
| 2006/0006784 | A1 | 1/2006 | Takahara et al. | |
| 2007/0188073 | A1 | 8/2007 | Yagi et al. | |
| 2007/0235686 | A1 | 10/2007 | Coda et al. | |
| 2008/0001519 | A1 | 1/2008 | Hansen | |
| 2010/0130092 | A1 * | 5/2010 | Ptaschek | C22C 7/00 445/26 |
| 2011/0250455 | A1 | 10/2011 | Gordon et al. | |
| 2014/0009059 | A1 * | 1/2014 | Ptaschek | C22C 7/00 313/490 |
| 2014/0055026 | A1 * | 2/2014 | Hutin | C22C 5/06 313/484 |

FOREIGN PATENT DOCUMENTS

| | | | |
|---|---|---|---|
| EP | 0033628 | A2 | 8/1981 |
| EP | 0 136 866 | | 4/1985 |
| EP | 1268353 | B1 | 1/2003 |
| EP | 1 381 485 | A2 | 1/2004 |
| EP | 1 381 485 | B1 | 3/2005 |
| EP | 2 145 028 | A1 | 1/2010 |
| EP | 2 145 028 | B1 | 7/2010 |
| JP | S-61186408 | A | 8/1986 |
| JP | S-62281249 | | 12/1987 |
| JP | 2000-251836 | A | 9/2000 |
| WO | 94/18692 | A1 | 8/1994 |
| WO | 02/087810 | A2 | 11/2002 |
| WO | 2008/132089 | A1 | 11/2008 |
| WO | 2012/119977 | | 9/2012 |

OTHER PUBLICATIONS

International Search Report for Application No. PCT/EP2012/053730 dated Jul. 6, 2012 (in English).
PCT Written Opinion of the International Searching Authority dated Sep. 9, 2013 with (English and German) translation.

* cited by examiner

*Primary Examiner* — Nimeshkumar Patel
*Assistant Examiner* — Christopher Raabe
(74) *Attorney, Agent, or Firm* — Smith, Gambrell & Russell, LLP

(57) ABSTRACT

Energy-saving lamps contain a gas filling of mercury vapor and argon in a gas discharge bulb. Amalgam balls are used for filling the gas discharge bulb with mercury. Novel coated balls whose operating life in the case of automatic metered introduction is increased by coating of the balls with an alloy powder and conglutination of the amalgam balls during storage and processing is prevented are proposed.

23 Claims, No Drawings

AMALGAM BALLS HAVING AN ALLOY COATING

Modern energy-saving lamps of the TFL (tube fluorescent lamp) or CFL (compact fluorescent lamp) type belong to the class of low-pressure gas discharge lamps. They consist of a gas discharge bulb which is filled with a mixture of mercury vapor and argon and is coated on the inside with a fluorescent phosphor. The ultraviolet radiation emitted by the mercury during operation is converted by the phosphor coating into visible light by fluorescence. The lamps are therefore also referred to as fluorescent lamps. Tanning and sterilizing lamps function according to the same principle, but are optimized for the emission of UV radiation and usually do not have a phosphor.

The mercury required for operation of these lamps has in the past been introduced as liquid metal into the gas discharge bulbs. However, introduction of the mercury in the form of amalgam balls into the gas discharge bulbs has been known for a long time. This aids handling of the toxic mercury and increases the accuracy of metering.

U.S. Pat. No. 4,145,634 describes the use of amalgam pellets containing 36 atom % of indium, which because of the high mercury content contain high proportions of liquid even at room temperature. The pellets therefore tend to stick together when they come into contact with one another. This can be prevented by coating the pellets with suitable materials in powder form. Proposed materials are stable metal oxides (titanium oxide, zirconium oxide, silicon dioxide, magnesium oxide and aluminum oxide), graphite, glass powder, phosphors, borax, antimony oxide and metal powders which do not form an amalgam with mercury (aluminum, iron and chromium).

WO 94/18692 describes the use of pellets composed of zinc amalgam containing from 5 to 60% by weight, preferably from 40 to 60% by weight, of mercury. To manufacture spheroidal amalgam pellets, the process described in U.S. Pat. No. 4,216,178, in which the molten amalgam is broken up into small droplets by an exit nozzle which is induced to vibrate and cooled to below the solidification temperature in a cooling medium, is used. The pellets according to WO 94/18692 are not coated.

To produce amalgam balls from the melt, the amalgam has to be heated to a temperature at which the amalgam is fully molten. In the case of a zinc amalgam, this is reliably ensured only at a temperature above 420° C. These high processing temperatures make appropriate safety precautions necessary because of the associated high vapor pressure of mercury and the toxicity of mercury.

JP 2000251836 describes the use of amalgam pellets composed of tin amalgam for producing fluorescent lamps. The tin amalgam preferably has only a low mercury content with a tin/mercury atomic ratio in the range 90-80:10-20. This corresponds to a mercury content of from 15.8 to 29.7% by weight. JP 2000251836 gives no information as to how spherical pellets are produced from the amalgam.

A disadvantage of the tin amalgam described in JP 2000251836 is the low mercury content. This makes relatively large amalgam balls necessary when a particular amount of mercury is to be introduced into the discharge lamps. Owing to the increasing miniaturization in the case of energy-saving lamps, too, this can lead to problems in construction and manufacture of the lamps.

EP 2145028 discloses amalgam balls having a relatively high mercury content, but these tend to stick together. Although this problem is reduced by proposed coating of the amalgam balls with an amalgam-forming metal powder, it is not completely solved for all purposes.

It is therefore an object of the invention to provide amalgam balls which have a high mercury content, can be stored safely without a risk to human health and can be used in the production of low-pressure gas discharge lamps such as energy-saving lamps and have improved properties in respect of their tendency to stick together.

This object is achieved by amalgam balls which are coated with an alloy powder, where the alloy powder has the composition Ag 3-80, Cu 0.5-43, Sn 0-96.5, Zn 0-5, In 0-10 and Au/Pd/Pt 0-5. Alloy powders which contain more than 3% by weight of silver or copper are particularly suitable when the tin content exceeds 90% by weight. Such alloy powders are very suitable when they form an amalgam with mercury.

BRIEF DESCRIPTION OF THE INVENTION

1. Amalgam balls which are suitable for low-pressure gas discharge lamps, in particular fluorescent lamps, tanning or sterilizing lamps, which are coated with an alloy powder,
   characterized in that
   the alloy powder has a composition of silver (Ag) from 3% by weight to 80% by weight, copper (Cu) from 0.5% by weight to 43% by weight, tin (Sn) from 0% by weight to 96.5% by weight, zinc (Zn) from 0% by weight to 5% by weight, indium (In) from 0% by weight to 10% by weight and gold, palladium and platinum (Au/Pd/Pt), individually or in combination with one another, from 0% by weight to 5% by weight, where the amounts of the metals add up to a total of 100% by weight.
2. Amalgam balls according to point 1,
   characterized in that
   the powder particles have a particle diameter of less than 100 μm.
3. Amalgam balls according to point 1 or 2,
   characterized in that
   the alloy powder contains more than 3% by weight of silver or copper when the tin content is greater than 90% by weight.
4. Amalgam balls according to one or more of points 1 to 3,
   characterized in that
   the amalgam balls are coated with an amount of from 1 to 10% by weight, based on the weight of the balls, of the alloy powder.
5. Amalgam balls according to one or more of points 1 to 4,
   characterized in that
   the alloy powder forms an amalgam with mercury.
6. Amalgam balls according to one or more of points 1 to 5,
   characterized in that
   the amalgam balls are additionally coated with an amount of from 0.001 to 1% by weight of a powder of a metal oxide.
7. Amalgam balls according to one or more of points 1 to 6,
   characterized in that the amalgam is an amalgam of the metals tin (Sn), zinc (Zn), bismuth (Bi), indium (In) and alloys of these with one another.
8. Amalgam balls according to one or more of points 1 to 7,
   characterized in that the amalgam is a tin amalgam or zinc amalgam having a mercury content of from 30% by weight to 70% by weight or an amalgam having the composition bismuth (Bi) to 100% by weight, tin (Sn) from 10% by weight to 30% by weight, mercury (Hg) from 10% by weight to 40% by weight or an amalgam having the composition bismuth (Bi) to 100% by weight, indium (In) from 25% by weight to 35% by weight, mercury (Hg) from 1% by weight to 20% by weight or an amalgam having the composition bismuth (Bi) to 100% by weight, mercury (Hg) from 3% by weight to 30% by weight, where the proportions in each case add up to 100% by weight.

9. Amalgam balls according to one or more of points 1 to 8, characterized in that
   the alloy powder has the composition silver (Ag) from 56% by weight to 72% by weight, copper (Cu) from 12.5% by weight to 28% by weight, tin (Sn) from 20% by weight to 35% by weight, zinc (Zn) from 0% by weight to 3% by weight, indium (In) from 0% by weight to 5% by weight and gold, palladium and platinum (Au/Pd/Pt), individually or in combination with one another, from 0% by weight to 5% by weight.
10. Amalgam balls according to one or more of points 1 to 8,
   characterized in that
   the alloy powder has the composition silver (Ag) from 56% by weight to 72% by weight, copper (Cu) from 12.5% by weight to 28% by weight, tin (Sn) from 0% by weight to 35% by weight, zinc (Zn) from 0% by weight to 3% by weight, indium (In) from 0% by weight to 5% by weight and gold, palladium and platinum (Au/Pd/Pt), individually or in combination with one another, from 0% by weight to 5% by weight.
11. Amalgam balls according to one or more of points 1 to 10,
   characterized in that
   the balls have a diameter in the range from 50 to 2000 μm.
12. Process for producing the amalgam balls according to one or more of points 1 to 11,
   characterized in that
   the amalgam is completely melted and the melt is introduced dropwise into a cooling medium having a temperature below the solidification temperature of the amalgam and the amalgam balls formed are subsequently separated off from the cooling medium.
13. Process according to point 12,
   characterized in that
   a mineral oil, an organic oil or a synthetic oil is used as cooling medium.
14. Process according to point 12 or 13,
   characterized in that
   the amalgam balls are degreased after having been separated from the cooling medium and are sprinkled at room temperature with an alloy powder according to one or more of claims 1 to 8 while agitating continually until the balls no longer stick together.
15. Process according to one or more of points 12 to 14,
   characterized in that
   the amalgam balls are additionally coated with a powder of a metal oxide in a further step while being agitated continually.
16. Process according to one or more of points 12 to 15, wherein the amalgam balls are subjected to a heat treatment after sprinkling with alloy powder.
17. Process according to point 16, wherein the heat treatment comprises heating the amalgam balls at a temperature of from 35° C. to 100° C. for a time of from 2 to 20 hours.
18. Process according to one or more of points 12 to 17, wherein at least one of the steps selected from the group consisting of sprinkling of the amalgam balls with alloy powder, coating with a metal oxide or heat treatment of the amalgam balls is repeated.
19. Method of controlling the reabsorption of mercury in amalgam balls for low-pressure gas discharge lamps, in particular fluorescent lamps, tanning or sterilizing lamps, by coating the amalgam balls with an alloy powder which has a composition according to one or more of points 1 to 11.
20. Use of the amalgam balls according to any of points 1 to 11 for producing low-pressure gas discharge lamps, in particular fluorescent lamps, tanning or sterilizing lamps.
21. Low-pressure gas discharge lamp, in particular a fluorescent lamp, tanning or sterilizing lamp, containing one or more amalgam balls according to any of points 1 to 11 enclosed in the low-pressure gas discharge lamp.
22. Process for producing low-pressure gas discharge lamps, in particular fluorescent lamps, tanning or sterilizing lamps, which comprises at least the following steps:
   provision of amalgam balls by a process according to any of points 12 to 18;
   provision of a glass body for the low-pressure gas discharge lamp;
   introduction of one or more amalgam balls into the glass body;
   closing of the glass body.

DETAILED DESCRIPTION OF THE INVENTION

The amalgam balls according to the invention are amalgams of the metals tin (Sn), zinc (Zn), bismuth (Bi), indium (In) and alloys of these with one another. In particular, these are amalgams having a mercury content in the range from 30 to 70% by weight and in further embodiments of the invention they have a mercury content of from 40 to 60% by weight and in particular from 40 to 55% by weight. Amalgam balls having these mercury contents are, in particular, tin amalgam balls but also zinc amalgam balls, i.e. SnHg30 to SnHg70, or SnHg40 to SnHg60, or SnHg45 to SnHg55 or SnHg50 or ZnHg30 to ZnHg70, or ZnHg40 to ZnHg60, or ZnHg45 to ZnHg55, or Bi to 100% by weight, from 10% to 30% by weight of Sn and from 10% by weight to 40% by weight of mercury (BiSn10-30Hg10-40). However, the problems addressed by the invention also occur in other amalgam balls which comprise far smaller amounts of mercury, e.g. amalgams of bismuth, indium or mixtures thereof and mercury. These are, in particular, amalgam balls having the composition Bi to 100% by weight, In from 25% by weight to 35% by weight, Hg from 1% by weight to 20% by weight or Bi to 100% by weight, In from 29% by weight to 32% by weight, Hg from 2% by weight to 8% by weight, for example BiIn29Hg3.5, BiIn29Hg5 or BiIn32Hg3.5 or else bismuth amalgams having a mercury content of from 3% by weight to 30% by weight (BiHg3 to BiHg30). The proportions of the metals of the alloy in each case add up to 100% by weight.

For the purposes of the invention, amalgam balls having diameters in the range from 50 μm to 3000 μm, in particular from 100 μm to 2500 μm, or from 200 μm to 2000 μm or in the range from 500 μm to 1500 μm, are particularly useful.

It has been found that liquid phases occur on the surface of the amalgam balls produced in this way, so that the balls stick to one another during storage and handling unless counter measures are undertaken. The tendency of the amalgam balls to stick to one another can be largely suppressed by coating the degreased balls with an alloy powder according to the invention. The alloy powders generally form an amalgam with the mercury. As a result of the amalgamation of the alloy powder, a surface layer having a low mercury content is formed on the balls and this layer no longer contains any phases which are liquid at the customary processing temperatures of the amalgam balls and thus suppresses the tendency to stick to one another compared to untreated balls.

The alloy powder used for coating should contain few or no particles having a particle diameter greater than 100 μm. Particles having larger particle diameters amalgamate only incompletely and lead to a rough surface of the balls, which makes metering of the balls more difficult. In this aspect, it is better to use an alloy powder whose powder particles have a particle diameter of less than 80 μm. In addition, alloy powders having an average particle diameter $d_{50}$ of from 2 μm to 20 μm or from 5 μm to 15 μm or from 2 μm to 15 μm or from 5 μm to 20 μm or from 2 m to 5 m are well-suited. The shape of the powder particles generally does not have to meet any particular requirements, so that spherical, angular, platelet-like, flock-like, acicular, granular alloy powders or combinations thereof can be used.

Suitable metals have been found to be alloys of tin or silver, preferably with one another, optionally also with zinc. Good results were obtained using alloys of tin with silver and copper. Suitable alloy powders have a composition of silver (Ag) from 3% by weight to 80% by weight, copper (Cu) from 0.5% by weight to 43% by weight, tin (Sn) from 0% by weight to 96.5% by weight, zinc (Zn) from 0% by weight to 5% by weight, indium (In) from 0% by weight to 10% by weight and gold, palladium and platinum (Au/Pd/Pt), individually or in combination with one another, from 0% by weight to 5% by weight, where the proportions of the metals add up to a total of 100% by weight. Alloy powders which contain more than 3% by weight of silver or copper are particularly suitable when the tin content exceeds 90% by weight. In a further embodiment of the invention, the alloy powders have the composition silver (Ag) from 24% by weight to 75% by weight, copper (Cu) from 5% by weight to 43% by weight or from 20% by weight to 30% by weight, tin (Sn) from 10% by weight to 48% by weight, zinc (Zn) from 0.1% by weight to 3% by weight, indium (In) from 0.1% by weight to 5% by weight and gold, palladium and platinum (Au/Pd/Pt), individually or in combination with one another, from 0.1% by weight to 5% by weight, where the proportions of the metals add up to a total of 100% by weight.

In a further embodiment of the invention, the alloy powders have the composition silver (Ag) from 56% by weight to 72% by weight, copper (Cu) from 12.5% by weight to 28% by weight, tin (Sn) from 20% by weight to 35% by weight, zinc (Zn) from 0% by weight to 3% by weight, indium (In) from 0% by weight to 5% by weight and gold, palladium and platinum (Au/Pd/Pt), individually or in combination with one another, from 0% by weight to 5% by weight, where the proportions of the metals add up to a total of 100% by weight.

In a further embodiment of the invention, the alloy powders have the composition silver (Ag) from 56% by weight to 72% by weight, copper (Cu) from 12.5% by weight to 28% by weight, tin (Sn) from 0% by weight to 35% by weight, zinc (Zn) from 0% by weight to 3% by weight, indium (In) from 0% by weight to 5% by weight and gold, palladium and platinum (Au/Pd/Pt), individually or in combination with one another, from 0% by weight to 5% by weight, where the proportions of the metals add up to a total of 100% by weight.

In a further embodiment of the invention, the alloy powders have the composition silver (Ag) from 56% by weight to 72% by weight, copper (Cu) from 12.5% by weight to 28% by weight, tin (Sn) from 0% by weight to 35% by weight, zinc (Zn) from 0% by weight to 3% by weight, indium (In) from 0% by weight to 5% by weight and gold, palladium and platinum (Au/Pd/Pt), individually or in combination with one another, from 0% by weight to 5% by weight, where the proportions of the metals add up to a total of 100% by weight.

In a further embodiment of the invention, the alloy powders have the composition silver (Ag) from 56% by weight to 72% by weight, copper (Cu) from 12.5% by weight to 28% by weight, tin (Sn) from 0% by weight to 35% by weight, zinc (Zn) from 0% by weight to 3% by weight, indium (In) from 0.1% by weight to 5% by weight and gold, palladium and platinum (Au/Pd/Pt), individually or in combination with one another, from 0% by weight to 5% by weight, where the proportions of the metals add up to a total of 100% by weight.

In a further embodiment of the invention, the alloy powders have the composition silver (Ag) from 56% by weight to 72% by weight, copper (Cu) from 12.5% by weight to 28% by weight, tin (Sn) from 0% by weight to 35% by weight, zinc (Zn) from 0% by weight 25 to 3% by weight, indium (In) from 0% by weight to 5% by weight and gold, palladium and platinum (Au/Pd/Pt), individually or in combination with one another, from 0.1% by weight to 5% by weight, where the proportions of the metals add up to a total of 100% by weight.

In a further embodiment of the invention, the alloy powders have the composition silver (Ag) from 56% by weight to 72% by weight, copper (Cu) from 12.5% by weight to 28% by weight, tin (Sn) from 0% by weight to 35% by weight, zinc (Zn) from 0% by weight to 3% by weight, indium (In) from 0% by weight to 5% by weight and gold, palladium and platinum (Au/Pd/Pt), individually or in combination with one another, from 1% by weight to 8% by weight, where the proportions of the metals add up to a total of 100% by weight.

Suitable combinations of the elements silver, zinc, indium and gold, palladium and platinum (individually or in combination with one another) are described in table 1 below. Suitable compositions of the alloy powders are shown in additional embodiments 2 to 17 below, where the copper and silver contents are also indicated. Individual combinations are designated by the number of the table followed by the number of the respective combination of the elements silver, zinc, indium and also gold, palladium and platinum (individually or in combination with one another) from table 1. For example, the alloy composition 2.005 means the combination of the elements silver, zinc, indium and gold, palladium and platinum as in table 1, item no. 5 (i.e. from 3 to 80% by weight of silver, from 0 to 3% by weight of zinc, from 0 to 5% by weight of indium, from 0.1 to 5% by weight of gold, palladium and platinum) with the contents of copper and silver indicated in additional embodiment 2.

| | Silver (Ag) % by wt. | Zinc (Zn) % by wt. | Indium (In) % by wt. | Gold, palladium and platinum (Au/Pd/Pt) % by wt. |
|---|---|---|---|---|
| 1. | 3 to 80 | 0 to 3 | 0 to 10 | 0 to 5 |
| 2. | 3 to 80 | 0 to 3 | 0 to 10 | 0.1 to 5 |
| 3. | 3 to 80 | 0 to 3 | 0 to 10 | 1 to 8 |
| 4. | 3 to 80 | 0 to 3 | 0 to 5 | 0 to 5 |
| 5. | 3 to 80 | 0 to 3 | 0 to 5 | 0.1 to 5 |
| 6. | 3 to 80 | 0 to 3 | 0 to 5 | 1 to 8 |
| 7. | 3 to 80 | 0 to 3 | 0.1 to 5 | 0 to 5 |
| 8. | 3 to 80 | 0 to 3 | 0.1 to 5 | 0.1 to 5 |
| 9. | 3 to 80 | 0 to 3 | 0.1 to 5 | 1 to 8 |

-continued

| | Silver (Ag) % by wt. | Zinc (Zn) % by wt. | Indium (In) % by wt. | Gold, palladium and platinum (Au/Pd/Pt) % by wt. |
|---|---|---|---|---|
| 10. | 3 to 80 | 0 to 5 | 0 to 10 | 0 to 5 |
| 11. | 3 to 80 | 0 to 5 | 0 to 10 | 0.1 to 5 |
| 12. | 3 to 80 | 0 to 5 | 0 to 10 | 1 to 8 |
| 13. | 3 to 80 | 0 to 5 | 0 to 5 | 0 to 5 |
| 14. | 3 to 80 | 0 to 5 | 0 to 5 | 0.1 to 5 |
| 15. | 3 to 80 | 0 to 5 | 0 to 5 | 1 to 8 |
| 16. | 3 to 80 | 0 to 5 | 0.1 to 5 | 0 to 5 |
| 17. | 3 to 80 | 0 to 5 | 0.1 to 5 | 0.1 to 5 |
| 18. | 3 to 80 | 0 to 5 | 0.1 to 5 | 1 to 8 |
| 19. | 3 to 80 | 0.1 to 3 | 0 to 10 | 0 to 5 |
| 20. | 3 to 80 | 0.1 to 3 | 0 to 10 | 0.1 to 5 |
| 21. | 3 to 80 | 0.1 to 3 | 0 to 10 | 1 to 8 |
| 22. | 3 to 80 | 0.1 to 3 | 0 to 5 | 0 to 5 |
| 23. | 3 to 80 | 0.1 to 3 | 0 to 5 | 0.1 to 5 |
| 24. | 3 to 80 | 0.1 to 3 | 0 to 5 | 1 to 8 |
| 25. | 3 to 80 | 0.1 to 3 | 0.1 to 5 | 0 to 5 |
| 26. | 3 to 80 | 0.1 to 3 | 0.1 to 5 | 0.1 to 5 |
| 27. | 3 to 80 | 0.1 to 3 | 0.1 to 5 | 1 to 8 |
| 28. | 24 to 75 | 0 to 3 | 0 to 10 | 0 to 5 |
| 29. | 24 to 75 | 0 to 3 | 0 to 10 | 0.1 to 5 |
| 30. | 24 to 75 | 0 to 3 | 0 to 10 | 1 to 8 |
| 31. | 24 to 75 | 0 to 3 | 0 to 5 | 0 to 5 |
| 32. | 24 to 75 | 0 to 3 | 0 to 5 | 0.1 to 5 |
| 33. | 24 to 75 | 0 to 3 | 0 to 5 | 1 to 8 |
| 34. | 24 to 75 | 0 to 3 | 0.1 to 5 | 0 to 5 |
| 35. | 24 to 75 | 0 to 3 | 0.1 to 5 | 0.1 to 5 |
| 36. | 24 to 75 | 0 to 3 | 0.1 to 5 | 1 to 8 |
| 37. | 24 to 75 | 0 to 5 | 0 to 10 | 0 to 5 |
| 38. | 24 to 75 | 0 to 5 | 0 to 10 | 0.1 to 5 |
| 39. | 24 to 75 | 0 to 5 | 0 to 10 | 1 to 8 |
| 40. | 24 to 75 | 0 to 5 | 0 to 5 | 0 to 5 |
| 41. | 24 to 75 | 0 to 5 | 0 to 5 | 0.1 to 5 |
| 42. | 24 to 75 | 0 to 5 | 0 to 5 | 1 to 8 |
| 43. | 24 to 75 | 0 to 5 | 0.1 to 5 | 0 to 5 |
| 44. | 24 to 75 | 0 to 5 | 0.1 to 5 | 0.1 to 5 |
| 45. | 24 to 75 | 0 to 5 | 0.1 to 5 | 1 to 8 |
| 46. | 24 to 75 | 0.1 to 3 | 0 to 10 | 0 to 5 |
| 47. | 24 to 75 | 0.1 to 3 | 0 to 10 | 0.1 to 5 |
| 48. | 24 to 75 | 0.1 to 3 | 0 to 10 | 1 to 8 |
| 49. | 24 to 75 | 0.1 to 3 | 0 to 5 | 0 to 5 |
| 50. | 24 to 75 | 0.1 to 3 | 0 to 5 | 0.1 to 5 |
| 51. | 24 to 75 | 0.1 to 3 | 0 to 5 | 1 to 8 |
| 52. | 24 to 75 | 0.1 to 3 | 0.1 to 5 | 0 to 5 |
| 53. | 24 to 75 | 0.1 to 3 | 0.1 to 5 | 0.1 to 5 |
| 54. | 24 to 75 | 0.1 to 3 | 0.1 to 5 | 1 to 8 |
| 55. | 56 to 72 | 0 to 3 | 0 to 10 | 0 to 5 |
| 56. | 56 to 72 | 0 to 3 | 0 to 10 | 0.1 to 5 |
| 57. | 56 to 72 | 0 to 3 | 0 to 10 | 1 to 8 |
| 58. | 56 to 72 | 0 to 3 | 0 to 5 | 0 to 5 |
| 59. | 56 to 72 | 0 to 3 | 0 to 5 | 0.1 to 5 |
| 60. | 56 to 72 | 0 to 3 | 0 to 5 | 1 to 8 |
| 61. | 56 to 72 | 0 to 3 | 0.1 to 5 | 0 to 5 |
| 62. | 56 to 72 | 0 to 3 | 0.1 to 5 | 0.1 to 5 |
| 63. | 56 to 72 | 0 to 3 | 0.1 to 5 | 1 to 8 |
| 64. | 56 to 72 | 0 to 5 | 0 to 10 | 0 to 5 |
| 65. | 56 to 72 | 0 to 5 | 0 to 10 | 0.1 to 5 |
| 66. | 56 to 72 | 0 to 5 | 0 to 10 | 1 to 8 |
| 67. | 56 to 72 | 0 to 5 | 0 to 5 | 0 to 5 |
| 68. | 56 to 72 | 0 to 5 | 0 to 5 | 0.1 to 5 |
| 69. | 56 to 72 | 0 to 5 | 0 to 5 | 1 to 8 |
| 70. | 56 to 72 | 0 to 5 | 0.1 to 5 | 0 to 5 |
| 71. | 56 to 72 | 0 to 5 | 0.1 to 5 | 0.1 to 5 |
| 72. | 56 to 72 | 0 to 5 | 0.1 to 5 | 1 to 8 |
| 73. | 56 to 72 | 0.1 to 3 | 0 to 10 | 0 to 5 |
| 74. | 56 to 72 | 0.1 to 3 | 0 to 10 | 0.1 to 5 |
| 75. | 56 to 72 | 0.1 to 3 | 0 to 10 | 1 to 8 |
| 76. | 56 to 72 | 0.1 to 3 | 0 to 5 | 0 to 5 |
| 77. | 56 to 72 | 0.1 to 3 | 0 to 5 | 0.1 to 5 |
| 78. | 56 to 72 | 0.1 to 3 | 0 to 5 | 1 to 8 |
| 79. | 56 to 72 | 0.1 to 3 | 0.1 to 5 | 0 to 5 |
| 80. | 56 to 72 | 0.1 to 3 | 0.1 to 5 | 0.1 to 5 |
| 81. | 56 to 72 | 0.1 to 3 | 0.1 to 5 | 1 to 8 |

Additional Embodiment 2

Additional Embodiment 2 consists of 81 alloy compositions 2.001 to 2.081, where the contents of the elements silver, zinc, indium and gold, palladium and platinum (individually or in combination with one another) are in each case indicated in % by weight in table 1 and the contents of tin (Sn) are from 0% by weight to 35% by weight and those of copper (Cu) are from 0.5% by weight to 43% by weight and the proportions of the metals add up to 100% by weight.

Additional Embodiment 3

Additional Embodiment 3 consists of 81 alloy compositions 3.001 to 3.081, where the contents of the elements silver, zinc, indium and gold, palladium and platinum (individually or in combination with one another) are in each case indicated in % by weight in table 1 and the contents of tin (Sn) are from 0% by weight to 35% by weight and those of copper (Cu) are from 12.5% by weight to 28% by weight and the proportions of the metals add up to 100% by weight.

Additional Embodiment 4

Additional Embodiment 4 consists of 81 alloy compositions 4.001 to 4.081, where the contents of the elements silver, zinc, indium and gold, palladium and platinum (individually or in combination with one another) are in each case indicated in % by weight in table 1 and the contents of tin (Sn) are from 0% by weight to 35% by weight and those of copper (Cu) are from 5% by weight to 43% by weight and the proportions of the metals add up to 100% by weight.

Additional Embodiment 5

Additional Embodiment 5 consists of 81 alloy compositions 5.001 to 5.081, where the contents of the elements silver, zinc, indium and gold, palladium and platinum (individually or in combination with one another) are in each case indicated in % by weight in table 1 and the contents of tin (Sn) are from 0% by weight to 35% by weight and those of copper (Cu) are from 20% by weight to 30% by weight and the proportions of the metals add up to 100% by weight.

Additional Embodiment 6

Additional Embodiment 6 consists of 81 alloy compositions 6.001 to 6.081, where the contents of the elements silver, zinc, indium and gold, palladium and platinum (individually or in combination with one another) are in each case indicated in % by weight in table 1 and the contents of tin (Sn) are from 0% by weight to 96.5% by weight and those of copper (Cu) are from 0.5% by weight to 43% by weight and the proportions of the metals add up to 100% by weight.

Additional Embodiment 7

Additional Embodiment 7 consists of 81 alloy compositions 7.001 to 7.081, where the contents of the elements silver, zinc, indium and gold, palladium and platinum (individually or in combination with one another) are in each case indicated in % by weight in table 1 and the contents of tin (Sn) are from 0% by weight to 96.5% by weight and those of copper (Cu) are from 12.5% by weight to 28% by weight and the proportions of the metals add up to 100% by weight.

Additional Embodiment 8

Additional Embodiment 8 consists of 81 alloy compositions 8.001 to 8.081, where the contents of the elements silver, zinc, indium and gold, palladium and platinum (individually or in combination with one another) are in each case indicated in % by weight in table 1 and the contents of tin (Sn) are from 0% by weight to 96.5% by weight and those of copper (Cu) are from 5% by weight to 43% by weight and the proportions of the metals add up to 100% by weight.

Additional Embodiment 9

Additional Embodiment 9 consists of 81 alloy compositions 9.001 to 9.081, where the contents of the elements silver, zinc, indium and gold, palladium and platinum (individually or in combination with one another) are in each case indicated in % by weight in table 1 and the contents of tin (Sn) are from 0% by weight to 96.5% by weight and those of copper (Cu) are from 20% by weight to 30% by weight and the proportions of the metals add up to 100% by weight.

Additional Embodiment 10

Additional Embodiment 10 consists of 81 alloy compositions 10.001 to 10.081, where the contents of the elements silver, zinc, indium and gold, palladium and platinum (individually or in combination with one another) are in each case indicated in % by weight in table 1 and the contents of tin (Sn) are from 10% by weight to 48% by weight and those of copper (Cu) are from 0.5% by weight to 43% by weight and the proportions of the metals add up to 100% by weight.

Additional Embodiment 11

Additional Embodiment 11 consists of 81 alloy compositions 11.001 to 11.081, where the contents of the elements silver, zinc, indium and gold, palladium and platinum (individually or in combination with one another) are in each case indicated in % by weight in table 1 and the contents of tin (Sn) are from 10% by weight to 48% by weight and those of copper (Cu) are from 12.5% by weight to 28% by weight and the proportions of the metals add up to 100% by weight.

Additional Embodiment 12

Additional Embodiment 12 consists of 81 alloy compositions 12.001 to 12.081, where the contents of the elements silver, zinc, indium and gold, palladium and platinum (individually or in combination with one another) are in each case indicated in % by weight in table 1 and the contents of tin (Sn) are from 10% by weight to 48% by weight and those of copper (Cu) are from 5% by weight to 43% by weight and the proportions of the metals add up to 100% by weight.

Additional Embodiment 13

Additional Embodiment 13 consists of 81 alloy compositions 13.001 to 13.081, where the contents of the elements silver, zinc, indium and gold, palladium and platinum (individually or in combination with one another) are in each case indicated in % by weight in table 1 and the contents of tin (Sn) are from 10% by weight to 48% by weight and those of copper (Cu) are from 20% by weight to 30% by weight and the proportions of the metals add up to 100% by weight.

Additional Embodiment 14

Additional Embodiment 14 consists of 81 alloy compositions 14.001 to 14.081, where the contents of the elements silver, zinc, indium and gold, palladium and platinum (individually or in combination with one another) are in each case indicated in % by weight in table 1 and the contents of tin (Sn) are from 20% by weight to 35% by weight and those of copper (Cu) are from 0.5% by weight to 43% by weight and the proportions of the metals add up to 100% by weight.

Additional Embodiment 15

Additional Embodiment 15 consists of 81 alloy compositions 15.001 to 15.081, where the contents of the elements silver, zinc, indium and gold, palladium and platinum (individually or in combination with one another) are in each case indicated in % by weight in table 1 and the contents of tin (Sn) are from 20% by weight to 35% by weight and those of copper (Cu) are from 12.5% by weight to 28% by weight and the proportions of the metals add up to 100% by weight.

Additional Embodiment 16

Additional Embodiment 16 consists of 81 alloy compositions 16.001 to 16.081, where the contents of the elements silver, zinc, indium and gold, palladium and platinum (individually or in combination with one another) are in each case indicated in % by weight in table 1 and the contents of tin (Sn) are from 20% by weight to 35% by weight and those of copper (Cu) are from 5% by weight to 43% by weight and the proportions of the metals add up to 100% by weight.

Additional Embodiment 17

Additional Embodiment 17 consists of 81 alloy compositions 17.001 to 17.081, where the contents of the elements silver, zinc, indium and gold, palladium and platinum (individually or in combination with one another) are in each case indicated in % by weight in table 1 and the contents of tin (Sn) are from 20% by weight to 35% by weight and those of copper (Cu) are from 20% by weight to 30% by weight and the proportions of the metals add up to 100% by weight.

Additional Embodiment 18

Additional Embodiment 18 consists of 81 alloy compositions 18.001 to 18.081, where the contents of the elements silver, zinc, indium and gold, palladium and platinum (individually or in combination with one another) are in each case indicated in % by weight in table 1 and the contents of tin (Sn) are from 0% by weight to 96.5% by weight and those of copper (Cu) are from 0.5% by weight to 43% by weight and the proportions of the metals add up to 100% by weight, with the copper content being greater than 3% by weight when the tin content exceeds 90% by weight and the silver content is less than 3% by weight.

Additional Embodiment 19

Additional Embodiment 19 consists of 81 alloy compositions 19.001 to 19.081, where the contents of the elements silver, zinc, indium and gold, palladium and platinum (individually or in combination with one another) are in each case indicated in % by weight in table 1 and the contents of tin (Sn) are from 0% by weight to 96.5% by weight and those of copper (Cu) are from 0.5% by weight to 43% by weight and the proportions of the metals add up to 100% by weight, where the silver content is greater than 3% by weight when the tin content exceeds 90% by weight and the copper content is less than 3% by weight.

Particularly suitable combinations of amalgam balls of particular sizes and compositions with compositions of alloy powders are shown in table 20 below. The compositions of the alloy powders are shown in additional embodiments 2 to 19, to which table 20 refers. Individual combinations are designated by the number in table 20, followed by the number of the respective combination of amalgam, ball diameter and the coating additional embodiment to be employed. For example, the combination 20.005 means the combination of a binary tin amalgam containing from 30 to 70% by weight of mercury and having a diameter of from 50 to 2000 μm with the coatings of additional embodiment 4.

| | Amalgam (range in % by weight) | | | | | Ball diameter in | Coating as per Additional |
|---|---|---|---|---|---|---|---|
| No. | Sn | Zn | Bi | In | Hg | the range μm | embodiment |
| 1. | to 100 | | | | 30-70 | 50 to 2000 | 2 |
| 2. | to 100 | | | | 30-70 | 500 to 1500 | 2 |
| 3. | to 100 | | | | 30-70 | 50 to 2000 | 3 |
| 4. | to 100 | | | | 30-70 | 500 to 1500 | 3 |
| 5. | to 100 | | | | 30-70 | 50 to 2000 | 4 |
| 6. | to 100 | | | | 30-70 | 500 to 1500 | 4 |
| 7. | to 100 | | | | 30-70 | 50 to 2000 | 5 |
| 8. | to 100 | | | | 30-70 | 500 to 1500 | 5 |
| 9. | to 100 | | | | 30-70 | 50 to 2000 | 6 |
| 10. | to 100 | | | | 30-70 | 500 to 1500 | 6 |
| 11. | to 100 | | | | 30-70 | 50 to 2000 | 7 |
| 12. | to 100 | | | | 30-70 | 500 to 1500 | 7 |
| 13. | to 100 | | | | 30-70 | 50 to 2000 | 8 |
| 14. | to 100 | | | | 30-70 | 500 to 1500 | 8 |
| 15. | to 100 | | | | 30-70 | 50 to 2000 | 9 |
| 16. | to 100 | | | | 30-70 | 500 to 1500 | 9 |
| 17. | to 100 | | | | 30-70 | 50 to 2000 | 10 |
| 18. | to 100 | | | | 30-70 | 500 to 1500 | 10 |
| 19. | to 100 | | | | 30-70 | 50 to 2000 | 11 |
| 20. | to 100 | | | | 30-70 | 500 to 1500 | 11 |
| 21. | to 100 | | | | 30-70 | 50 to 2000 | 12 |
| 22. | to 100 | | | | 30-70 | 500 to 1500 | 12 |
| 23. | to 100 | | | | 30-70 | 50 to 2000 | 13 |
| 24. | to 100 | | | | 30-70 | 500 to 1500 | 13 |
| 25. | to 100 | | | | 30-70 | 50 to 2000 | 14 |
| 26. | to 100 | | | | 30-70 | 500 to 1500 | 14 |
| 27. | to 100 | | | | 30-70 | 50 to 2000 | 15 |
| 28. | to 100 | | | | 30-70 | 500 to 1500 | 15 |
| 29. | to 100 | | | | 30-70 | 50 to 2000 | 16 |
| 30. | to 100 | | | | 30-70 | 500 to 1500 | 16 |
| 31. | to 100 | | | | 30-70 | 50 to 2000 | 17 |
| 32. | to 100 | | | | 30-70 | 500 to 1500 | 17 |
| 33. | to 100 | | | | 30-70 | 50 to 2000 | 18 |
| 34. | to 100 | | | | 30-70 | 500 to 1500 | 18 |
| 35. | to 100 | | | | 30-70 | 50 to 2000 | 19 |
| 36. | to 100 | | | | 30-70 | 500 to 1500 | 19 |
| 37. | to 100 | | | | 40-55 | 50 to 2000 | 2 |
| 38. | to 100 | | | | 40-55 | 500 to 1500 | 2 |
| 39. | to 100 | | | | 40-55 | 50 to 2000 | 3 |
| 40. | to 100 | | | | 40-55 | 500 to 1500 | 3 |
| 41. | to 100 | | | | 40-55 | 50 to 2000 | 4 |
| 42. | to 100 | | | | 40-55 | 500 to 1500 | 4 |
| 43. | to 100 | | | | 40-55 | 50 to 2000 | 5 |
| 44. | to 100 | | | | 40-55 | 500 to 1500 | 5 |
| 45. | to 100 | | | | 40-55 | 50 to 2000 | 6 |
| 46. | to 100 | | | | 40-55 | 500 to 1500 | 6 |
| 47. | to 100 | | | | 40-55 | 50 to 2000 | 7 |
| 48. | to 100 | | | | 40-55 | 500 to 1500 | 7 |
| 49. | to 100 | | | | 40-55 | 50 to 2000 | 8 |
| 50. | to 100 | | | | 40-55 | 500 to 1500 | 8 |
| 51. | to 100 | | | | 40-55 | 50 to 2000 | 9 |
| 52. | to 100 | | | | 40-55 | 500 to 1500 | 9 |
| 53. | to 100 | | | | 40-55 | 50 to 2000 | 10 |
| 54. | to 100 | | | | 40-55 | 500 to 1500 | 10 |
| 55. | to 100 | | | | 40-55 | 50 to 2000 | 11 |
| 56. | to 100 | | | | 40-55 | 500 to 1500 | 11 |
| 57. | to 100 | | | | 40-55 | 50 to 2000 | 12 |
| 58. | to 100 | | | | 40-55 | 500 to 1500 | 12 |
| 59. | to 100 | | | | 40-55 | 50 to 2000 | 13 |
| 60. | to 100 | | | | 40-55 | 500 to 1500 | 13 |
| 61. | to 100 | | | | 40-55 | 50 to 2000 | 14 |
| 62. | to 100 | | | | 40-55 | 500 to 1500 | 14 |
| 63. | to 100 | | | | 40-55 | 50 to 2000 | 15 |
| 64. | to 100 | | | | 40-55 | 500 to 1500 | 15 |
| 65. | to 100 | | | | 40-55 | 50 to 2000 | 16 |
| 66. | to 100 | | | | 40-55 | 500 to 1500 | 16 |
| 67. | to 100 | | | | 40-55 | 50 to 2000 | 17 |
| 68. | to 100 | | | | 40-55 | 500 to 1500 | 17 |

-continued

| No. | Amalgam (range in % by weight) Sn | Zn | Bi | In | Hg | Ball diameter in the range μm | Coating as per Additional embodiment |
|---|---|---|---|---|---|---|---|
| 69. | to 100 | | | | 40-55 | 50 to 2000 | 18 |
| 70. | to 100 | | | | 40-55 | 500 to 1500 | 18 |
| 71. | to 100 | | | | 40-55 | 50 to 2000 | 19 |
| 72. | to 100 | | | | 40-55 | 500 to 1500 | 19 |
| 73. | | to 100 | | | 40-60 | 50 to 2000 | 2 |
| 74. | | to 100 | | | 40-60 | 500 to 1500 | 2 |
| 75. | | to 100 | | | 40-60 | 50 to 2000 | 3 |
| 76. | | to 100 | | | 40-60 | 500 to 1500 | 3 |
| 77. | | to 100 | | | 40-60 | 50 to 2000 | 4 |
| 78. | | to 100 | | | 40-60 | 500 to 1500 | 4 |
| 79. | | to 100 | | | 40-60 | 50 to 2000 | 5 |
| 80. | | to 100 | | | 40-60 | 500 to 1500 | 5 |
| 81. | | to 100 | | | 40-60 | 50 to 2000 | 6 |
| 82. | | to 100 | | | 40-60 | 500 to 1500 | 6 |
| 83. | | to 100 | | | 40-60 | 50 to 2000 | 7 |
| 84. | | to 100 | | | 40-60 | 500 to 1500 | 7 |
| 85. | | to 100 | | | 40-60 | 50 to 2000 | 8 |
| 86. | | to 100 | | | 40-60 | 500 to 1500 | 8 |
| 87. | | to 100 | | | 40-60 | 50 to 2000 | 9 |
| 88. | | to 100 | | | 40-60 | 500 to 1500 | 9 |
| 89. | | to 100 | | | 40-60 | 50 to 2000 | 10 |
| 90. | | to 100 | | | 40-60 | 500 to 1500 | 10 |
| 91. | | to 100 | | | 40-60 | 50 to 2000 | 11 |
| 92. | | to 100 | | | 40-60 | 500 to 1500 | 11 |
| 93. | | to 100 | | | 40-60 | 50 to 2000 | 12 |
| 94. | | to 100 | | | 40-60 | 500 to 1500 | 12 |
| 95. | | to 100 | | | 40-60 | 50 to 2000 | 13 |
| 96. | | to 100 | | | 40-60 | 500 to 1500 | 13 |
| 97. | | to 100 | | | 40-60 | 50 to 2000 | 14 |
| 98. | | to 100 | | | 40-60 | 500 to 1500 | 14 |
| 99. | | to 100 | | | 40-60 | 50 to 2000 | 15 |
| 100. | | to 100 | | | 40-60 | 500 to 1500 | 15 |
| 101. | | to 100 | | | 40-60 | 50 to 2000 | 16 |
| 102. | | to 100 | | | 40-60 | 500 to 1500 | 16 |
| 103. | | to 100 | | | 40-60 | 50 to 2000 | 17 |
| 104. | | to 100 | | | 40-60 | 500 to 1500 | 17 |
| 105. | | to 100 | | | 40-60 | 50 to 2000 | 18 |
| 106. | | to 100 | | | 40-60 | 500 to 1500 | 18 |
| 107. | | to 100 | | | 40-60 | 50 to 2000 | 19 |
| 108. | | to 100 | | | 40-60 | 500 to 1500 | 19 |
| 109. | | | to 100 | 25-35 | 2-8 | 50 to 2000 | 2 |
| 110. | | | to 100 | 25-35 | 2-8 | 500 to 1500 | 2 |
| 111. | | | to 100 | 25-35 | 2-8 | 50 to 2000 | 3 |
| 112. | | | to 100 | 25-35 | 2-8 | 500 to 1500 | 3 |
| 113. | | | to 100 | 25-35 | 2-8 | 50 to 2000 | 4 |
| 114. | | | to 100 | 25-35 | 2-8 | 500 to 1500 | 4 |
| 115. | | | to 100 | 25-35 | 2-8 | 50 to 2000 | 5 |
| 116. | | | to 100 | 25-35 | 2-8 | 500 to 1500 | 5 |
| 117. | | | to 100 | 25-35 | 2-8 | 50 to 2000 | 6 |
| 118. | | | to 100 | 25-35 | 2-8 | 500 to 1500 | 6 |
| 119. | | | to 100 | 25-35 | 2-8 | 50 to 2000 | 7 |
| 120. | | | to 100 | 25-35 | 2-8 | 500 to 1500 | 7 |
| 121. | | | to 100 | 25-35 | 2-8 | 50 to 2000 | 8 |
| 122. | | | to 100 | 25-35 | 2-8 | 500 to 1500 | 8 |
| 123. | | | to 100 | 25-35 | 2-8 | 50 to 2000 | 9 |
| 124. | | | to 100 | 25-35 | 2-8 | 500 to 1500 | 9 |
| 125. | | | to 100 | 25-35 | 2-8 | 50 to 2000 | 10 |
| 126. | | | to 100 | 25-35 | 2-8 | 500 to 1500 | 10 |
| 127. | | | to 100 | 25-35 | 2-8 | 50 to 2000 | 11 |
| 128. | | | to 100 | 25-35 | 2-8 | 500 to 1500 | 11 |
| 129. | | | to 100 | 25-35 | 2-8 | 50 to 2000 | 12 |
| 130. | | | to 100 | 25-35 | 2-8 | 500 to 1500 | 12 |
| 131. | | | to 100 | 25-35 | 2-8 | 50 to 2000 | 13 |
| 132. | | | to 100 | 25-35 | 2-8 | 500 to 1500 | 13 |
| 133. | | | to 100 | 25-35 | 2-8 | 50 to 2000 | 14 |
| 134. | | | to 100 | 25-35 | 2-8 | 500 to 1500 | 14 |
| 135. | | | to 100 | 25-35 | 2-8 | 50 to 2000 | 15 |
| 136. | | | to 100 | 25-35 | 2-8 | 500 to 1500 | 15 |
| 137. | | | to 100 | 25-35 | 2-8 | 50 to 2000 | 16 |
| 138. | | | to 100 | 25-35 | 2-8 | 500 to 1500 | 16 |
| 139. | | | to 100 | 25-35 | 2-8 | 50 to 2000 | 17 |
| 140. | | | to 100 | 25-35 | 2-8 | 500 to 1500 | 17 |
| 141. | | | to 100 | 25-35 | 2-8 | 50 to 2000 | 18 |
| 142. | | | to 100 | 25-35 | 2-8 | 500 to 1500 | 18 |

-continued

| No. | Amalgam (range in % by weight) Sn | Zn | Bi | In | Hg | Ball diameter in the range μm | Coating as per Additional embodiment |
|---|---|---|---|---|---|---|---|
| 143. | | | to 100 | 25-35 | 2-8 | 50 to 2000 | 19 |
| 144. | | | to 100 | 25-35 | 2-8 | 500 to 1500 | 19 |
| 145. | | 35-60 | 5-20 | | 30-45 | 50 to 2000 | 2 |
| 146. | | 35-60 | 5-20 | | 30-45 | 500 to 1500 | 2 |
| 147. | | 35-60 | 5-20 | | 30-45 | 50 to 2000 | 3 |
| 148. | | 35-60 | 5-20 | | 30-45 | 500 to 1500 | 3 |
| 149. | | 35-60 | 5-20 | | 30-45 | 50 to 2000 | 4 |
| 150. | | 35-60 | 5-20 | | 30-45 | 500 to 1500 | 4 |
| 151. | | 35-60 | 5-20 | | 30-45 | 50 to 2000 | 5 |
| 152. | | 35-60 | 5-20 | | 30-45 | 500 to 1500 | 5 |
| 153. | | 35-60 | 5-20 | | 30-45 | 50 to 2000 | 6 |
| 154. | | 35-60 | 5-20 | | 30-45 | 500 to 1500 | 6 |
| 155. | | 35-60 | 5-20 | | 30-45 | 50 to 2000 | 7 |
| 156. | | 35-60 | 5-20 | | 30-45 | 500 to 1500 | 7 |
| 157. | | 35-60 | 5-20 | | 30-45 | 50 to 2000 | 8 |
| 158. | | 35-60 | 5-20 | | 30-45 | 500 to 1500 | 8 |
| 159. | | 35-60 | 5-20 | | 30-45 | 50 to 2000 | 9 |
| 160. | | 35-60 | 5-20 | | 30-45 | 500 to 1500 | 9 |
| 161. | | 35-60 | 5-20 | | 30-45 | 50 to 2000 | 10 |
| 162. | | 35-60 | 5-20 | | 30-45 | 500 to 1500 | 10 |
| 163. | | 35-60 | 5-20 | | 30-45 | 50 to 2000 | 11 |
| 164. | | 35-60 | 5-20 | | 30-45 | 500 to 1500 | 11 |
| 165. | | 35-60 | 5-20 | | 30-45 | 50 to 2000 | 12 |
| 166. | | 35-60 | 5-20 | | 30-45 | 500 to 1500 | 12 |
| 167. | | 35-60 | 5-20 | | 30-45 | 50 to 2000 | 13 |
| 168. | | 35-60 | 5-20 | | 30-45 | 500 to 1500 | 13 |
| 169. | | 35-60 | 5-20 | | 30-45 | 50 to 2000 | 14 |
| 170. | | 35-60 | 5-20 | | 30-45 | 500 to 1500 | 14 |
| 171. | | 35-60 | 5-20 | | 30-45 | 50 to 2000 | 15 |
| 172. | | 35-60 | 5-20 | | 30-45 | 500 to 1500 | 15 |
| 173. | | 35-60 | 5-20 | | 30-45 | 50 to 2000 | 16 |
| 174. | | 35-60 | 5-20 | | 30-45 | 500 to 1500 | 16 |
| 175. | | 35-60 | 5-20 | | 30-45 | 50 to 2000 | 17 |
| 176. | | 35-60 | 5-20 | | 30-45 | 500 to 1500 | 17 |
| 177. | | 35-60 | 5-20 | | 30-45 | 50 to 2000 | 18 |
| 178. | | 35-60 | 5-20 | | 30-45 | 500 to 1500 | 18 |
| 179. | | 35-60 | 5-20 | | 30-45 | 50 to 2000 | 19 |
| 180. | | 35-60 | 5-20 | | 30-45 | 500 to 1500 | 19 |
| 181. | | 0.2-0.8 | to 100 | 29-31 | 1-3 | 500 to 1500 | 2 |
| 182. | | 0.2-0.8 | to 100 | 29-31 | 1-3 | 500 to 1500 | 3 |
| 183. | | 0.2-0.8 | to 100 | 29-31 | 1-3 | 500 to 1500 | 4 |
| 184. | | 0.2-0.8 | to 100 | 29-31 | 1-3 | 500 to 1500 | 5 |
| 185. | | 0.2-0.8 | to 100 | 29-31 | 1-3 | 500 to 1500 | 6 |
| 186. | | 0.2-0.8 | to 100 | 29-31 | 1-3 | 500 to 1500 | 7 |
| 187. | | 0.2-0.8 | to 100 | 29-31 | 1-3 | 500 to 1500 | 8 |
| 188. | | 0.2-0.8 | to 100 | 29-31 | 1-3 | 500 to 1500 | 9 |
| 189. | | 0.2-0.8 | to 100 | 29-31 | 1-3 | 500 to 1500 | 10 |
| 190. | | 0.2-0.8 | to 100 | 29-31 | 1-3 | 500 to 1500 | 11 |
| 191. | | 0.2-0.8 | to 100 | 29-31 | 1-3 | 500 to 1500 | 12 |
| 192. | | 0.2-0.8 | to 100 | 29-31 | 1-3 | 500 to 1500 | 13 |
| 193. | | 0.2-0.8 | to 100 | 29-31 | 1-3 | 500 to 1500 | 14 |
| 194. | | 0.2-0.8 | to 100 | 29-31 | 1-3 | 500 to 1500 | 15 |
| 195. | | 0.2-0.8 | to 100 | 29-31 | 1-3 | 500 to 1500 | 16 |
| 196. | | 0.2-0.8 | to 100 | 29-31 | 1-3 | 500 to 1500 | 17 |
| 197. | | 0.2-0.8 | to 100 | 29-31 | 1-3 | 500 to 1500 | 18 |
| 198. | | 0.2-0.8 | to 100 | 29-31 | 1-3 | 500 to 1500 | 19 |

The amalgam balls can be produced from a melt of the amalgam by a process described in EP 1381485 B1. For this purpose, the fully molten amalgam is introduced dropwise into a cooling medium having a temperature below the solidification temperature of the amalgam. The temperature of the cooling medium is preferably from 10 to 20° C. below the liquidus temperature of the amalgam. In an embodiment of the invention, the molten amalgam is introduced dropwise into the cooling medium via a vibrating nozzle; in a further embodiment of the invention, the nozzle dips into the cooling medium. The outlay for ensuring occupational hygiene in the production of the amalgam balls is therefore significantly reduced. Another advantage is that tin amalgams melt completely at temperatures below 230° C.

As cooling medium, preference is given to using a mineral oil, an organic oil or a synthetic oil. A silicone oil has been found to be very useful. After formation of the amalgam balls in the cooling medium, they are separated off from the cooling medium and degreased.

To coat the amalgam balls with the metal or alloy powder, the balls can, after decreasing, be placed, for example, in a rotating vessel and sprinkled with the metal or alloy powder while agitating continually until the balls no longer stick to one another. Well-suited apparatuses for carrying out this process step are, for example, V-blenders, tubular mixers or coating drums. The amount of metal or alloy powder apply here to the amalgam balls is in the range from 1 to 10% by weight, preferably from 2 to 4% by weight, based on the weight of the amalgam balls.

A further reduction in the tendency to stick together is achieved when the amalgam balls are, after coating with the metal or alloy powder, additionally coated with an amount of from 0.001 to 1% by weight, preferably from 0.01 to 0.5% by weight and in particular an amount of 0.1% by weight, based on the weight of the amalgam balls, of a powder of a metal oxide. For this purpose, exactly the same procedure as in the application of the metal or alloy powder can be employed. Suitable metal oxides for this coating are, for example, titanium oxide, zirconium oxide, silicon oxide and aluminum oxide. Preference is given to using aluminum oxide prepared by flame pyrolysis and having an average particle size of less than 5 μm, preferably less than 1 μm. Coating of the amalgam balls is thus effected by degreasing the amalgam balls after they have been separated off from the cooling medium and sprinkling them with an alloy powder as described above at room temperature while agitating continually until the balls no longer stick to one another. A further reduction in the tendency to stick together can be brought about by additionally coating the amalgam balls with a powder of a metal oxide in a further step while agitating continually. A further reduction in the tendency to stick together can be brought about by subjecting the amalgam balls to a heat treatment after sprinkling with alloy powder. This heat treatment can be carried out by heating the amalgam balls at a temperature of from 35° C. to 100° C. for a time of from 2 to 20 hours. In a further embodiment of the invention, one of the steps selected from the group consisting of sprinkling of the amalgam balls with alloy powder, coating with a metal oxide or heat treatment of the amalgam balls can be repeated. In this case, the desired coating with alloy powder or metal oxide is thus not achieved in one step, but instead the alloy powder is applied in a first step and (optionally after removal of excess alloy powder) coated again with an alloy powder, as described above, in a further step. In the same way, metal oxide can also be applied in a plurality of steps. The alloy powders or metal oxides which are applied in the various steps can be identical or different, so that multilayer coatings, optionally alternating alloy powder layers and metal oxide layers, can also be obtained, with the alloy powders and metal oxide in each case being able to be different from one another.

If various alloy powders or metal oxide powders are applied, these can differ in terms of their chemical composition but also merely in terms of physical properties such as particle sizes or particle size distributions. A coating comprising two different alloy powders according to the invention is also present when, for example, a coating of an alloy powder having an average particle diameter $d_{50}$ of 50 μm is applied in a first step and a coating of an alloy powder having the same chemical composition and an average particle diameter $d_{50}$ of 15 μm is applied in a subsequent step.

The present invention also provides a process for producing low-pressure gas discharge lamps, in particular fluorescent lamps, tanning or sterilizing lamps, which comprises the steps:

- provision of amalgam balls according to the invention;
- provision of a glass body for the low-pressure gas discharge lamp;
- introduction of one or more amalgam balls into the glass body;
- closing of the glass body.

The amalgam balls coated according to the invention with alloy powder are provided as described above. The glass body of the gas discharge lamp or fluorescent lamp is in the simplest case a glass tube which can be bent one or more times and often has a diameter of from about 4 mm to 80 mm, in particular from 6 mm to 40 mm. In the case of conventional fluorescent tubes, it is possible to use a simple, straight glass tube, while multiply bent glass tubes having a diameter of from 4 to 10 mm are usually used for energy-saving lamps. The amalgam balls according to the invention are then introduced into the glass tube. These are usually placed in particular positions which are provided with a receptacle for the amalgam balls or are fixed in a predetermined place so that the amalgam balls remain at this place. The amalgam balls can be warmed at this place during further use of the fluorescent lamp. Introduction can also be effected by fixing the amalgam ball or the amalgam balls according to the invention in the receptacle and then introducing them. The receptacle can also be a part which is installed on or in the fluorescent lamp, for example a closure for the glass body. The desired atmosphere is then produced in the glass body, if this has not already been done, for example by flushing with a gas (such as argon), evacuation of the glass body or a combination thereof. To generate visible light, the glass body has to be provided with a fluorescent phosphor. Calcium halophosphates are often used as phosphors. The detailed procedure for this purpose is known to those skilled in the art and is generally carried out for fluorescent lamps. The glass body of the lamp is then closed and optionally processed further. The further processing can comprise a plurality of subsequent steps such as cleaning, provision with electrical contacts or mounts or installation in a protective container. These possibilities for further processing are known per se and comprise, for example, steps such as further cleaning, attachment of contacts or mounts or attachment of electric and/or electronic components, e.g. attachment of ballasts.

In addition, it has surprisingly been found that the powder coating has a favorable influence on the mercury reabsorption properties. The present invention therefore also provides amalgam balls which have been coated according to the invention with an alloy powder even when these amalgam balls do not tend to stick to one another without a coating. The invention therefore also provides a method of controlling the reabsorption of mercury in amalgam balls by coating of the amalgam balls with an alloy powder having a composition as described above.

The powder layers applied to the amalgam balls improve the handleability of the amalgam balls in automatic metering machines. In such automatic metering machines, the amalgam balls can be at room temperature for an average of up to three hours before they are introduced into a fluorescent lamp. It has been found that the amalgam balls according to the invention survive the average residence time of 24 hours at temperatures of up to 40° C. in the automatic metering machine without problems.

Examples

Using the method of EP 1381485, amalgam balls having the compositions indicated below and a diameter of about 1 mm±0.1 mm are produced, classified and, after degreasing, coated with an alloy powder as indicated in the table by agitation in a tubular mixer for one minute. To test the mechanical stability of the amalgam balls, an amount of about 4000 amalgam balls is placed in an automatic metering machine and introduced at a rotational speed of one revolution per minute into fluorescent lamps. The operating life of the balls is evaluated according to the scheme indicated below, with determination in each case of the time at which either production had to be interrupted because of the balls sticking to one another or visual inspection found such a large amount of contamination by detached alloy powder that interruption was necessary for cleaning the automatic metering machine and charging with fresh amalgam balls. In the case of amalgam balls given a grade of 0 and having an SnHg50 alloy as amalgam, the remaining balls are heated at 50 degrees celsius for four hours, and, after cooling, once again tested in an automatic metering machine as described above. These heat-treated balls have an operating life which always led to a better grade (i.e. + or ++). The comparative examples display only a small improvement in the operating lives (less than one hour). Grade: ++ operating life >5 h, + operating life >4 h, 0 operating life >3 h, – operating life <1 h.

TABLE

| Examples and comparative examples | | | | | | | | | | |
|---|---|---|---|---|---|---|---|---|---|---|
| Example | | | | | | | Alloy powder for coating | | | |
| | Amalgam (% by weight) | | | | | | Composition (% by weight) | | | |
| No. | Sn | Zn | Bi | In | Hg | Evaluation | % Ag | % Cu | % Sn | Others |
| 1. | to 100 | | | | 50 | 0 | 44.5 | 30 | 25.5 | — |
| 2. | to 100 | | | | 50 | ++ | 70 | 12 | 18 | — |
| 3. | to 100 | | | | 50 | 0 | 43.1 | 26.1 | 30.8 | — |
| 4. | to 100 | | | | 50 | ++ | 69.3 | 10.9 | 19.4 | Zn: 0.4 |
| 5. | to 100 | | | | 50 | 0 | 42 | 26 | 32 | — |
| 6. | to 100 | | | | 50 | ++ | 96.4 | 4.6 | 26 | Hg: 3% |
| 7. | to 100 | | | | 50 | + | 50 | 20 | 30 | — |
| 8. | to 100 | | | | 50 | 0 | 40.5 | 27.6 | 31.9 | — |
| 9. | to 100 | | | | 50 | + | 69.2 | 18.6 | 11.9 | Zn: 0.3 |
| 10. | to 100 | | | | 50 | 0 | 45 | 24 | 30.5 | Zn: 0.5 |
| 11. | to 100 | | | | 50 | + | 60 | 12 | 28 | — |
| 12. | to 100 | | | | 50 | 0 | 40.5 | 27.6 | 31.9 | — |
| 13. | to 100 | | | | 50 | 0 | 3 | 0.5 | 96.5 | — |
| 14. | to 100 | | | | 50 | + | 72 | 28 | — | — |
| 15. | to 100 | | | | 50 | ++ | 69.5 | 10.5 | 19.5 | Zn: 0.5 |
| 16. | to 100 | | | | 50 | 0 | 45.5 | 23 | 31.5 | — |
| 17. | to 100 | | | | 50 | ++ | 60 | 12 | 28 | — |
| 18. | to 100 | | | | 50 | + | 67.9 | 13.3 | 18.8 | — |
| 19. | to 100 | | | | 50 | 0 | 40 | 28 | 32 | — |
| 20. | to 100 | | | | 50 | ++ | 60.5 | 11.5 | 28 | — |
| 21. | to 100 | | | | 50 | + | 43 | 25 | 32 | — |
| 22. | to 100 | | | | 50 | + | 57 | 25 | 8 | — |
| 23. | to 100 | | | | 50 | 0 | 46 | 22.5 | 31.5 | — |
| 24. | to 100 | | | | 50 | + | 52.5 | 17.5 | 29.7 | Pd: 0.3 |
| 25. | to 100 | | | | 40 | 0 | 44.5 | 30 | 25.5 | — |
| 26. | to 100 | | | | 40 | ++ | 70 | 12 | 18 | — |
| 27. | to 100 | | | | 40 | 0 | 43.1 | 26.1 | 30.8 | — |
| 28. | to 100 | | | | 40 | ++ | 69.3 | 10.9 | 19.4 | Zn: 0.4 |
| 29. | to 100 | | | | 40 | 0 | 42 | 26 | 32 | — |
| 30. | to 100 | | | | 40 | + | 69.4 | 4.6 | 26 | Hg: 3% |
| 31. | to 100 | | | | 40 | ++ | 50 | 20 | 30 | — |
| 32. | to 100 | | | | 40 | 0 | 40.5 | 27.6 | 31.9 | — |
| 33. | to 100 | | | | 40 | + | 69.2 | 18.6 | 11.9 | Zn: 0.3 |
| 34. | to 100 | | | | 40 | + | 45 | 24 | 30.5 | Zn: 0.5 |
| 35. | to 100 | | | | 40 | + | 60 | 12 | 28 | — |
| 36. | to 100 | | | | 40 | 0 | 40.5 | 27.6 | 31.9 | — |
| 37. | to 100 | | | | 40 | 0 | 3 | 0.5 | 96.5 | — |
| 38. | to 100 | | | | 40 | + | 72 | 28 | — | — |
| 39. | to 100 | | | | 40 | ++ | 69.5 | 10.5 | 19.5 | Zn: 0.5 |
| 40. | to 100 | | | | 40 | + | 45.5 | 23 | 31.5 | — |
| 41. | to 100 | | | | 40 | ++ | 60 | 12 | 28 | — |
| 42. | to 100 | | | | 40 | + | 67.9 | 13.3 | 18.8 | — |
| 43. | to 100 | | | | 40 | 0 | 40 | 28 | 32 | — |
| 44. | to 100 | | | | 40 | ++ | 60.5 | 11.5 | 28 | — |
| 45. | to 100 | | | | 40 | 0 | 43 | 25 | 32 | — |
| 46. | to 100 | | | | 40 | ++ | 57 | 25 | 28 | — |
| 47. | to 100 | | | | 40 | 0 | 46 | 22.5 | 31.5 | — |
| 48. | to 100 | | | | 40 | + | 52.5 | 17.5 | 29.7 | Pd: 0.3 |
| 49. | | to 100 | | | 50 | + | 44.5 | 30 | 25.5 | — |
| 50. | | to 100 | | | 50 | + | 70 | 12 | 18 | — |
| 51. | | to 100 | | | 50 | 0 | 43.1 | 26.1 | 30.8 | — |
| 52. | | to 100 | | | 50 | ++ | 69.3 | 10.9 | 19.4 | Zn: 0.4 |
| 53. | | to 100 | | | 50 | 0 | 42 | 26 | 32 | — |
| 54. | | to 100 | | | 50 | + | 69.4 | 4.6 | 26 | Hg: 3% |
| 55. | | to 100 | | | 50 | + | 50 | 20 | 30 | — |
| 56. | | to 100 | | | 50 | 0 | 40.5 | 27.6 | 31.9 | — |
| 57. | | to 100 | | | 50 | + | 69.2 | 18.6 | 11.9 | Zn: 0.3 |
| 58. | | to 100 | | | 50 | 0 | 45 | 24 | 30.5 | Zn: 0.5 |
| 59. | | to 100 | | | 50 | + | 60 | 12 | 28 | — |
| 60. | | to 100 | | | 50 | 0 | 40.5 | 27.6 | 31.9 | — |
| 61. | | to 100 | | | 50 | 0 | 3 | 0.5 | 96.5 | — |

TABLE-continued

| Examples and comparative examples | | | | | | | | | | |
|---|---|---|---|---|---|---|---|---|---|---|
| Example | | | | | | Alloy powder for coating | | | | |
| | Amalgam (% by weight) | | | | | | Composition (% by weight) | | | |
| No. | Sn | Zn | Bi | In | Hg | Evaluation | % Ag | % Cu | % Sn | Others |
| 62. | | to 100 | | | 50 | ++ | 72 | 28 | — | — |
| 63. | | to 100 | | | 50 | ++ | 69.5 | 10.5 | 19.5 | Zn: 0.5 |
| 64. | | to 100 | | | 50 | 0 | 45.5 | 23 | 31.5 | — |
| 65. | | to 100 | | | 50 | ++ | 60 | 12 | 28 | — |
| 66. | | to 100 | | | 50 | + | 67.9 | 13.3 | 18.8 | — |
| 67. | | to 100 | | | 50 | 0 | 40 | 28 | 32 | — |
| 68. | | to 100 | | | 50 | ++ | 60.5 | 11.5 | 28 | — |
| 69. | | to 100 | | | 50 | 0 | 43 | 25 | 32 | — |
| 70. | | to 100 | | | 50 | 0 | 57 | 25 | 28 | — |
| 71. | | to 100 | | | 50 | 0 | 46 | 22.5 | 31.5 | — |
| 72. | | to 100 | | | 50 | + | 52.5 | 17.5 | 29.7 | Pd: 0.3 |
| 73. | | | to 100 | 29 | 5 | + | 44.5 | 30 | 25.5 | — |
| 74. | | | to 100 | 29 | 5 | ++ | 70 | 12 | 18 | — |
| 75. | | | to 100 | 29 | 5 | 0 | 43.1 | 26.1 | 30.8 | — |
| 76. | | | to 100 | 29 | 5 | ++ | 69.3 | 10.9 | 19.4 | Zn: 0.4 |
| 77. | | | to 100 | 29 | 5 | 0 | 42 | 26 | 32 | — |
| 78. | | | to 100 | 29 | 5 | ++ | 69.4 | 4.6 | 26 | Hg: 3% |
| 79. | | | to 100 | 29 | 5 | + | 50 | 20 | 30 | — |
| 80. | | | to 100 | 29 | 5 | + | 40.5 | 27.6 | 31.9 | — |
| 81. | | | to 100 | 29 | 5 | + | 69.2 | 18.6 | 11.9 | Zn: 0.3 |
| 82. | | | to 100 | 29 | 5 | 0 | 45 | 24 | 30.5 | Zn: 0.5 |
| 83. | | | to 100 | 29 | 5 | + | 60 | 12 | 28 | — |
| 84. | | | to 100 | 29 | 5 | 0 | 40.5 | 27.6 | 31.9 | — |
| 85. | | | to 100 | 29 | 5 | 0 | 3 | 0.5 | 96.5 | — |
| 86. | | | to 100 | 29 | 5 | + | 72 | 28 | — | — |
| 87. | | | to 100 | 29 | 5 | ++ | 69.5 | 10.5 | 19.5 | Zn: 0.5 |
| 88. | | | to 100 | 29 | 5 | 0 | 45.5 | 23 | 31.5 | — |
| 89. | | | to 100 | 29 | 5 | ++ | 60 | 12 | 28 | — |
| 90. | | | to 100 | 29 | 5 | + | 67.9 | 13.3 | 18.8 | — |
| 91. | | | to 100 | 29 | 5 | 0 | 40 | 28 | 32 | — |
| 92. | | | to 100 | 29 | 5 | ++ | 60.5 | 11.5 | 28 | — |
| 93. | | | to 100 | 29 | 5 | 0 | 43 | 25 | 32 | — |
| 94. | | | to 100 | 29 | 5 | + | 57 | 25 | 28 | — |
| 95. | | | to 100 | 29 | 5 | 0 | 46 | 22.5 | 31.5 | — |
| 96. | | | to 100 | 29 | 5 | 0 | 52.5 | 17.5 | 29.7 | Pd: 0.3 |
| 97. | 20 | | to 100 | | 20 | 0 | 44.5 | 30 | 25.5 | — |
| 98. | 20 | | to 100 | | 20 | ++ | 70 | 12 | 18 | — |
| 99. | 20 | | to 100 | | 20 | 0 | 43.1 | 26.1 | 30.8 | — |
| 100. | 20 | | to 100 | | 20 | ++ | 69.3 | 10.9 | 19.4 | Zn: 04 |
| 101. | 20 | | to 100 | | 20 | 0 | 42 | 26 | 32 | — |
| 102. | 20 | | to 100 | | 20 | ++ | 69.4 | 4.6 | 26 | Hg: 3% |
| 103. | 20 | | to 100 | | 20 | + | 50 | 20 | 30 | — |
| 104. | 20 | | to 100 | | 20 | 0 | 40.5 | 27.6 | 31.9 | — |
| 105. | 20 | | to 100 | | 20 | + | 69.2 | 18.6 | 11.9 | Zn: 0.3 |
| 106. | 20 | | to 100 | | 20 | 0 | 45 | 24 | 30.5 | Zn: 0.5 |
| 107. | 20 | | to 100 | | 20 | + | 60 | 12 | 28 | — |
| 108. | 20 | | to 100 | | 20 | 0 | 40.5 | 27.6 | 31.9 | — |
| 109. | 20 | | to 100 | | 20 | 0 | 3 | 0.5 | 96.5 | — |
| 110. | 20 | | to 100 | | 20 | + | 72 | 28 | — | — |
| 111. | 20 | | to 100 | | 20 | + | 69.5 | 10.5 | 19.5 | Zn: 0.5 |
| 112. | 20 | | to 100 | | 20 | + | 45.5 | 23 | 31.5 | — |
| 113. | 20 | | to 100 | | 20 | ++ | 60 | 12 | 28 | — |
| 114. | 20 | | to 100 | | 20 | + | 67.9 | 13.3 | 18.8 | — |
| 115. | 20 | | to 100 | | 20 | 0 | 40 | 28 | 32 | — |
| 116. | 20 | | to 100 | | 20 | ++ | 60.5 | 1.5 | 28 | — |
| 117. | 20 | | to 100 | | 20 | + | 43 | 25 | 32 | — |
| 118. | 20 | | to 100 | | 20 | ++ | 57 | 25 | 28 | — |
| 119. | 20 | | to 100 | | 20 | 0 | 46 | 22.5 | 31.5 | — |
| 120. | 20 | | to 100 | | 20 | ++ | 52.5 | 17.5 | 29.7 | Pd: 0.3 |
| Comparative examples | | | | | | | | | | |
| 121. | to 100 | | | | 50 | — | — | 100 | — | — |
| 122. | to 100 | | | | 50 | — | — | — | 100 | — |
| 123. | to 100 | | | | 50 | — | — | — | — | Zn: 100 |
| 124. | to 100 | | | | 40 | — | — | 100 | — | — |
| 125. | to 100 | | | | 40 | — | — | — | 100 | — |
| 126. | to 100 | | | | 40 | — | — | — | — | Zn: 100 |
| 127. | | to 100 | | | 50 | — | — | 100 | — | — |
| 128. | | to 100 | | | 50 | — | — | — | 100 | — |
| 129. | | to 100 | | | 50 | — | — | — | — | Zn: 100 |
| 130. | | | to 100 | 29 | 5 | — | — | 100 | — | — |
| 131. | | | to 100 | 29 | 5 | — | — | — | 100 | — |

TABLE-continued

| Examples and comparative examples | | | | | | | | | | |
|---|---|---|---|---|---|---|---|---|---|---|
| Example | | | | | | | Alloy powder for coating | | | |
| | Amalgam (% by weight) | | | | | | Composition (% by weight) | | | |
| No. | Sn | Zn | Bi | In | Hg | Evaluation | % Ag | % Cu | % Sn | Others |
| 132. | | | to 100 | 29 | 5 | — | — | — | — | Zn: 100 |
| 133. | 20 | | to 100 | | 20 | — | — | 100 | — | — |
| 134. | 20 | | to 100 | | 20 | — | — | — | 100 | — |
| 135. | 20 | | to 100 | | 20 | — | — | — | — | Zn: 100 |

The invention claimed is:

1. A process for producing amalgam balls which are coated with an alloy powder, wherein the alloy powder has a composition of silver (Ag) from 3% by weight to 80% by weight, copper (Cu) from 0.5% by weight to 43% by weight, tin (Sn) from 0% by weight to 96.5% by weight, zinc (Zn) from 0% by weight to 5% by weight, indium (In) from 0% by weight to 10% by weight and gold, palladium and platinum (Au/Pd/Pt), individually or in combination with one another, from 0% by weight to 5% by weight, where the amounts of the metals add up to a total of 100% by weight, said process comprising:

melting the amalgam;

introducing the melt dropwise into a cooling medium having a temperature below the solidification temperature of the amalgam to form amalgam balls;

separating the formed amalgam balls from the cooling medium;

degreasing the formed amalgam balls;

sprinkling the formed amalgam balls at room temperature with the alloy powder while agitating continually until the amalgam balls no longer stick together; and subjecting the amalgam balls to a heat treatment in the process for producing the amalgam balls.

2. The process of claim 1, wherein the alloy powder has powder particles that have a particle diameter of less than 100 μm.

3. The process of claim 1, wherein the alloy powder contains more than 3% by weight of silver or copper when the tin content is greater than 90% by weight.

4. The process of claim 1, wherein the amalgam ball is coated with an amount of from 1 to 10% by weight, based on the weight of the ball, of the alloy powder.

5. The process of claim 1, wherein the amalgam ball is additionally coated with an amount of from 0.001 to 1% by weight of a powder of a metal oxide.

6. The process of claim 1, wherein the amalgam is an amalgam of the metals tin (Sn), zinc (Zn), bismuth (Bi), indium (In) and alloys of these with one another.

7. The process of claim 1, wherein the ball has a diameter in the range from 50 to 3000 μm.

8. A process for producing amalgam balls which are coated with an alloy powder, wherein the alloy powder has a composition of silver (Ag) from 3% by weight to 80% by weight, copper (Cu) from 0.5% by weight to 43% by weight, tin (Sn) from 0% by weight to 96.5% by weight, zinc (Zn) from 0% by weight to 5% by weight, indium (In) from 0% by weight to 10% by weight and gold, palladium and platinum (Au/Pd/Pt), individually or in combination with one another, from 0% by weight to 5% by weight, where the amounts of the metals add up to a total of 100% by weight, wherein the amalgam is completely melted and the melt is introduced dropwise into a cooling medium having a temperature below the solidification temperature of the amalgam and the amalgam balls formed are subsequently separated off from the cooling medium, wherein the amalgam balls are degreased after having been separated from the cooling medium and are sprinkled at room temperature with the alloy powder while agitating continually until the balls no longer stick together, and wherein the amalgam balls are subjected to a heat treatment after sprinkling with alloy powder.

9. A process for producing a low-pressure gas discharge lamp comprising inclusion of at least one of the amalgam balls produced by the process of claim 1 in a lamp body.

10. A low-pressure gas discharge lamp containing at least one amalgam ball produced by the process of claim 1 which is enclosed in the low-pressure gas discharge lamp.

11. The process of claim 1, further comprising: coating the formed amalgam balls with a metal oxide.

12. The process of claim 11, wherein at least one of the steps selected from the group consisting of sprinkling of the amalgam balls with alloy powder, coating with a metal oxide or heat treatment of the amalgam balls is repeated.

13. The process of claim 1, wherein the amalgam balls are subjected to a heat treatment of 35° C. to 100° C. for 2 to 20 hours.

14. The process of claim 1, wherein the heat treatment is carried out such that the alloy powders form a surface layer amalgam with the amalgam balls on which they are sprinkled.

15. A process for producing low-pressure gas discharge lamps, which comprises at least the following steps:

providing amalgam balls which are coated with an alloy powder, wherein the alloy powder has a composition of silver (Ag) from 3% by weight to 80% by weight, copper (Cu) from 0.5% by weight to 43% by weight, tin (Sn) from 0% by weight to 96.5% by weight, zinc (Zn) from 0% by weight to 5% by weight, indium (In) from 0% by weight to 10% by weight, and gold, palladium and platinum (Au/Pd/Pt), individually or in combination with one another, from 0% by weight to 5% by weight, where the amounts of the metals add up to a total of 100% by weight, and wherein the amalgam balls are produced by a process comprising:

melting the amalgam;

introducing the melt dropwise into a cooling medium having a temperature below the solidification temperature of the amalgam to form amalgam balls;

separating the formed amalgam balls from the cooling medium;

degreasing the formed amalgam balls;

sprinkling the formed amalgam balls at room temperature with the alloy powder while agitating continually until the amalgam balls no longer stick together; and subjecting the amalgam balls to a heat treatment;

provision of a glass body for the low-pressure gas discharge lamp;

introduction of one or more amalgam balls that has been subjected to said heat treatment into the glass body; and closing of the glass body.

16. The process of claim 15, wherein the powder particles have a particle diameter of less than 100 μm.

17. The process of claim 15, wherein the alloy powder contains more than 3% by weight of silver or copper when the tin content is greater than 90% by weight.

18. The process of claim 15, wherein the amalgam ball is coated with an amount of from 1 to 10% by weight, based on the weight of the ball, of the alloy powder.

19. The process of claim 15, wherein the amalgam ball is additionally coated with an amount of from 0.001 to 1% by weight of a powder of a metal oxide.

20. The process of claim 19, wherein at least one of the steps selected from the group consisting of sprinkling of the amalgam balls with alloy powder, coating with a metal oxide or heat treatment of the amalgam balls is repeated.

21. The process of claim 15, wherein the amalgam is an amalgam of the metals tin (Sn), zinc (Zn), bismuth (Bi), indium (In) and alloys of these with one another.

22. The process of claim 15, wherein the ball has a diameter in the range from 50 to 3000 μm.

23. The process of claim 15, wherein the heat treatment is carried out such that the alloy powders form a surface layer amalgam with the amalgam balls on which they are sprinkled.

* * * * *